US011703783B2

(12) United States Patent
Sugiyama

(10) Patent No.: US 11,703,783 B2
(45) Date of Patent: Jul. 18, 2023

(54) FIXING DEVICE AND IMAGE FORMING APPARATUS

(71) Applicant: Ryohhei Sugiyama, Kanagawa (JP)

(72) Inventor: Ryohhei Sugiyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/842,794

(22) Filed: Jun. 17, 2022

(65) Prior Publication Data

US 2023/0063831 A1 Mar. 2, 2023

(30) Foreign Application Priority Data

Aug. 31, 2021 (JP) ..... 2021-141438

(51) Int. Cl.
*G03G 15/20* (2006.01)

(52) U.S. Cl.
CPC ..... *G03G 15/2053* (2013.01); *G03G 15/2064* (2013.01); *G03G 2215/2032* (2013.01)

(58) Field of Classification Search
CPC ..... G03G 15/2053; G03G 15/2064; G03G 2215/2032; G03G 15/2025
See application file for complete search history.

(56) References Cited

U.S. PATENT DOCUMENTS 4,280,708 A * 7/1981 Arai ..... F16J 9/16 277/467
4,487,158 A * 12/1984 Kayson ..... G03G 15/2028 432/60
5,275,422 A * 1/1994 Rehfeld ..... F16J 9/06 92/208
9,989,897 B2 * 6/2018 Okamoto ..... G03G 15/2025
2015/0104227 A1 * 4/2015 Shimokawa ..... G03G 15/2053 399/329
2016/0161891 A1 * 6/2016 Tanto ..... G03G 15/2053 399/33
2016/0274510 A1 * 9/2016 Hase ..... G03G 15/2042
2017/0115610 A1 * 4/2017 Yoshiura ..... G03G 15/2025
2017/0131666 A1 5/2017 Sugiyama et al.
2017/0146933 A1 5/2017 Yamano et al.
2018/0088502 A1 3/2018 Sugiyama et al.

FOREIGN PATENT DOCUMENTS

JP 4009126 B2 * 11/2007
JP 2017-009948 1/2017
JP 2017-120331 7/2017
JP 2019-211690 12/2019

* cited by examiner

*Primary Examiner* — Sevan A Aydin
(74) *Attorney, Agent, or Firm* — Xsensus LLP

(57) ABSTRACT

A fixing device includes a fixing belt that is endless and rotatable. A nip formation pad is disposed opposite an inner circumferential face of the fixing belt via a lubricant. A pressure roller sandwiches the fixing belt together with the nip formation pad to form a pressing region through which a recording medium is conveyed. A cap is disposed opposite a lateral end of the fixing belt in an axial direction of the fixing belt. A seal is tubular and contacts an outer circumferential face of the fixing belt in at least a part of an inner circumferential face of the seal. The seal seals a gap between the cap and the fixing belt. The seal includes a non-perpendicular portion that is not perpendicular to a circumferential direction of the fixing belt and defines a slit.

14 Claims, 5 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-141438, filed on Aug. 31, 2021, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data.

Such image forming apparatuses include a fixing device that fixes a toner image on a recording medium. The fixing device includes a nip formation pad that is disposed opposite an inner circumferential face of a fixing belt via a lubricant. A pressure roller is pressed against the nip formation pad via the fixing belt, forming a pressing region between the fixing belt and the pressure roller. The lubricant may move from the inner circumferential face to an outer circumferential face of the fixing belt through an edge face of the fixing belt. The lubricant may degrade the toner image on the recording medium or may slip the pressure roller over the fixing belt.

SUMMARY

This specification describes below an improved fixing device. In one embodiment, the fixing device includes a fixing belt that is endless and rotatable. A nip formation pad is disposed opposite an inner circumferential face of the fixing belt via a lubricant. A pressure roller sandwiches the fixing belt together with the nip formation pad to form a pressing region through which a recording medium is conveyed. A cap is disposed opposite a lateral end of the fixing belt in an axial direction of the fixing belt. A seal is tubular and contacts an outer circumferential face of the fixing belt in at least a part of an inner circumferential face of the seal. The seal seals a gap between the cap and the fixing belt. The seal includes a non-perpendicular portion that is not perpendicular to a circumferential direction of the fixing belt and defines a slit.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
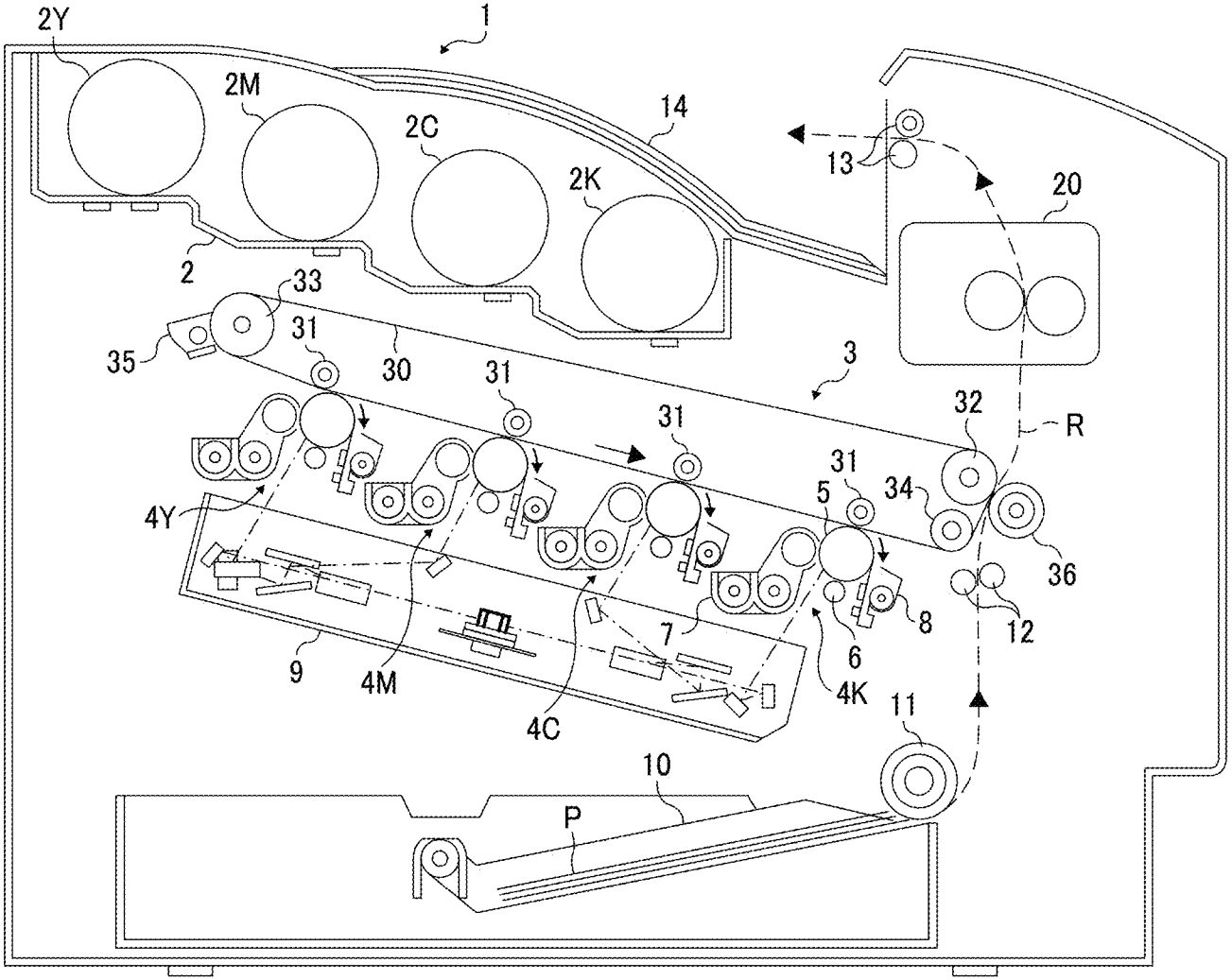
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to attached drawings, the following describes embodiments of the present disclosure. In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of an image forming apparatus 1 according to an embodiment of the present disclosure, illustrating one example of a construction of the image forming apparatus 1.

As illustrated in FIG. 1, the image forming apparatus 1 is a color laser printer. Four image forming devices 4Y, 4M, 4C, and 4K that form toner images, respectively, are disposed in a center of a body of the image forming apparatus 1.

The image forming devices 4Y, 4M, 4C, and 4K have a similar construction except that the image forming devices 4Y, 4M, 4C, and 4K contain developers in different colors, that is, yellow (Y), magenta (M), cyan (C), and black (K), respectively, which correspond to color separation components for a color image.

For example, each of the image forming devices 4Y, 4M, 4C, and 4K includes a photoconductor 5, a charger 6, a developing device 7, and a cleaner 8. The photoconductor is drum-shaped and serves as a latent image bearer or an image bearer. The charger 6 charges a surface of the photoconductor 5. The developing device 7 supplies toner to the surface of the photoconductor 5. The cleaner 8 cleans the surface of the photoconductor 5.

FIG. 1 assigns reference numerals to the photoconductor 5, the charger 6, the developing device 7, and the cleaner 8 of the image forming device 4K that forms a black toner image. Reference numerals for elements of the image forming devices 4Y, 4M, and 4C are omitted.

Below the image forming devices 4Y, 4M 4C and 4K is an exposure device 9 that exposes the surface of the photoconductor 5.

A transfer device 3 is disposed above the image forming devices 4Y, 4M, 4C, and 4K in FIG. 1. The transfer device 3 transfers toner images, that is, yellow, magenta, cyan, and black toner images, formed on the photoconductors 5, respectively, onto a sheet P serving as a recording medium. The transfer device 3 includes an intermediate transfer belt 30, four primary transfer rollers 31, a secondary transfer roller 36, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As the secondary transfer backup roller 32 is driven and rotated, the intermediate transfer belt 30 revolves around or rotates in a direction indicated with an arrow in FIG. 1.

The belt cleaner 35 removes residual toner failed to be transferred onto the sheet P and therefore remaining on the intermediate transfer belt 30 therefrom.

A bottle housing 2 is disposed in an upper portion of the body of the image forming apparatus 1. Four toner bottles 2Y, 2M, 2C, and 2K, which contain toners to be supplied to the image forming devices 4Y, 4M, 4C, and 4K, respectively, are detachably attached to the bottle housing 2. The toner bottles 2Y, 2M, 2C, and 2K supply yellow, magenta, cyan, and black toners to the developing devices 7 of the image forming devices 4Y, 4M, 4C, and 4K, respectively.

In a lower portion of the body of the image forming apparatus 1 are a sheet feeding tray 10 (e.g., a paper tray), a feed roller 11, and the like. The sheet feeding tray 10 stores 5 sheets P serving as recording media. The feed roller 11 feeds and conveys a sheet P of the sheets P stored in the sheet feeding tray 10. The recording media include plain paper, thick paper, a postcard, an envelope, thin paper, coated paper, art paper, tracing paper, and an overhead projector (OHP) transparency. Optionally, the image forming apparatus 1 may include a bypass feeder (e.g., a bypass tray).

A conveyance path R is disposed in the body of the image forming apparatus 1. The sheet P is conveyed from the sheet feeding tray 10 through the conveyance path R via a secondary transfer nip formed between the intermediate transfer belt 30 and the secondary transfer roller 36 to an outside of the image forming apparatus 1.

The conveyance path R is provided with a registration roller pair 12 that is disposed upstream from the secondary transfer roller 36 in a sheet conveyance direction in which the sheet P is conveyed. The registration roller pair 12 serves as a conveyor that conveys the sheet P to the secondary transfer nip.

Downstream from the secondary transfer roller 36 in the sheet conveyance direction is a fixing device 20 that fixes an unfixed toner image transferred from the intermediate transfer belt 30 onto the sheet P thereon.

The conveyance path R is further provided with a sheet ejecting roller pair 13 that is disposed downstream from the fixing device 20 in the sheet conveyance direction. The sheet ejecting roller pair 13 ejects the sheet P onto the outside of the image forming apparatus 1. A sheet ejection tray 14 (e.g., an output tray) is disposed atop the body of the image forming apparatus 1. The sheet ejection tray 14 stocks the sheet P ejected onto the outside of the image forming apparatus 1.

A description is provided of a construction of the fixing device 20.

Figure 2:
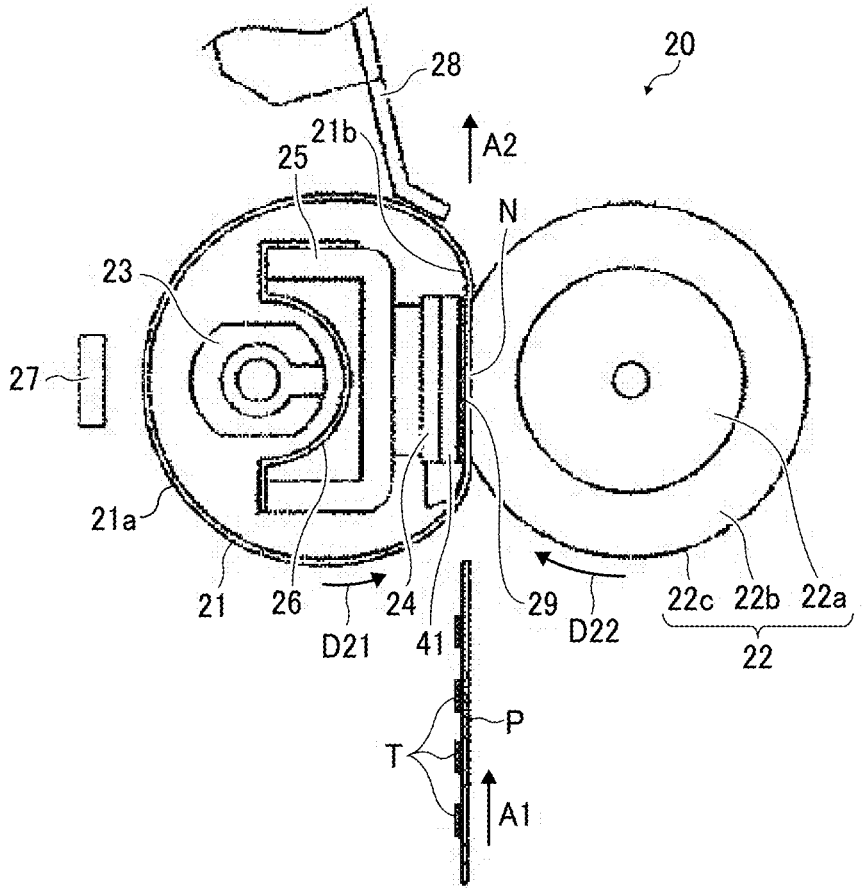
FIG. 2 is a cross-sectional view of a fixing device incorporated in the image forming apparatus depicted in FIG. 1.

FIG. 2 is a cross-sectional view of the fixing device 20 according to an embodiment of the present disclosure, illustrating the construction of the fixing device 20.

The fixing device 20 includes a fixing belt 21 and a pressure roller 22. The fixing belt 21 serves as a fixing rotator or a fixing member that is rotatable in a rotation direction D21. The fixing belt 21 is a moving body that is hollow and has an endless face. The pressure roller 22 serves as a pressure rotator, a pressure member, or an opposed rotator that is disposed opposite the fixing belt 21 and is rotatable in a rotation direction D22.

Inside a loop formed by the fixing belt 21 are a halogen heater 23 and a nip formation pad 24. The halogen heater 23 serves as a heater that heats the fixing belt 21. The nip formation pad 24 is disposed opposite the pressure roller 22 via the fixing belt 21 to form a fixing nip N between the fixing belt 21 and the pressure roller 22. A reflector 26 is disposed within the loop formed by the fixing belt 21. The reflector 26 reflects light radiated from the halogen heater 23 toward the fixing belt 21. The halogen heater 23 is secured to and supported by side plates of the fixing device 20.

The fixing device 20 further includes a temperature sensor 27, a separation plate 28, and a pressurization assembly. The temperature sensor 27 serves as a temperature detector that is disposed opposite an outer circumferential face 21*a* of the fixing belt 21 and detects a temperature of the fixing belt 21. The separation plate 28 serves as a recording medium separator that separates the sheet P from the fixing belt 21. The pressurization assembly presses the pressure roller 22 against the fixing belt 21.

The fixing belt 21 is an endless belt or film that is thin and has flexibility. The fixing belt 21 includes a base layer and a release layer. The base layer is an inner circumferential layer made of a metal material such as nickel and stainless steel or a resin material such as polyimide (PI). The release layer is an outer circumferential layer made of tetrafluoroethylene-perfluoroalkylvinylether copolymer (PFA), polytetrafluoroethylene (PTFE), or the like. Optionally, an elastic layer made of a rubber material such as silicone rubber may be interposed between the base layer and the release layer.

The pressure roller 22 and the nip formation pad 24 sandwich the fixing belt 21. The pressure roller 22 forms a pressing region (e.g., the fixing nip N) through which the sheet P is conveyed. The pressure roller 22 drives and rotates the fixing belt 21. The pressure roller 22 is constructed of a core metal 22*a*, an elastic layer 22*b*, and a release layer 22*c*.

The elastic layer 22*b* coats the core metal 22*a* and is made of silicone rubber foam, silicone rubber, fluororubber, or the like. The release layer 22*c* coats the elastic layer 22*b* and is made of PFA, PTFE, or the like.

The pressurization assembly such as a spring presses the pressure roller 22 toward the fixing belt 21, pressing the pressure roller 22 against the nip formation pad 24 via the fixing belt 21. At a position where the pressure roller 22 is pressed against the fixing belt 21, the elastic layer 22*b* of the pressure roller 22 is pressed and deformed to form the fixing nip N having a predetermined length in sheet conveyance directions A1 and A2.

A driver such as a motor disposed inside the body of the image forming apparatus 1 drives and rotates the pressure roller 22. As the driver drives and rotates the pressure roller 22, a driving force generated by the driver is transmitted from the pressure roller 22 to the fixing belt 21 at the fixing nip N, rotating the fixing belt 21 in accordance with rotation of the pressure roller 22.

According to this embodiment, the pressure roller 22 is a solid roller. Alternatively, the pressure roller 22 may be a hollow roller. In this case, a heater such as a halogen heater may be disposed inside the pressure roller 22.

The fixing device 20 depicted in FIG. 2 incorporates the halogen heater 23 that heats the fixing belt 21 directly with radiant heat (e.g., light) generated by the halogen heater 23. The halogen heater 23 serving as the heater is disposed within the loop formed by the fixing belt 21.

A power supply disposed inside the body of the image forming apparatus 1 supplies power to the halogen heater 23. A controller controls the power supply to output power to the halogen heater 23 to generate heat.

The controller controls the power supply to output power to the halogen heater 23 based on a temperature of a surface of the fixing belt 21, which is detected by the temperature sensor 27, for example. The controller turns on and off the halogen heater 23 or adjusts an amount of power supplied to the halogen heater 23. The controller controls the power supply to output power to the halogen heater 23 as described above, adjusting the temperature of the fixing belt 21 to a desired temperature (e.g., a fixing temperature).

Alternatively, as a heater that heats the fixing belt 21, an induction heater (OH), a resistive heat generator, a ceramic heater, a carbon heater, or the like may be employed instead of a halogen heater.

The nip formation pad 24 extends in a longitudinal direction thereof throughout an entirety of the fixing belt 21 or the pressure roller 22 in an axial direction thereof. The nip formation pad 24 is secured to and supported by a stay 25. Hence, the nip formation pad 24 is not bent by pressure from the pressure roller 22, attaining a uniform nip length of the fixing nip N in the sheet conveyance directions A1 and A2 throughout the entirety of the pressure roller 22 in the axial direction thereof. In order to prevent the nip formation pad 24 from being bent, the stay 25 is preferably made of a metal material having an enhanced mechanical strength such as stainless steel and iron. Alternatively, the stay 25 may be made of resin. The stay 25 is secured to and supported by the side plates of the fixing device 20.

The reflector 26 is interposed between the stay 25 and the halogen heater 23. According to this embodiment, the reflector 26 is secured to the stay 25. Since the halogen heater 23 heats the reflector 26 directly, the reflector 26 is preferably made of a metal material or the like having an increased melting point. The reflector 26 disposed as described above reflects light radiated from the halogen heater 23 toward the stay 25 to the fixing belt 21. Accordingly, the reflector 26 increases an amount of light that irradiates the fixing belt 21, heating the fixing belt 21 effectively. Additionally, the reflector 26 suppresses conduction of radiant heat from the halogen heater 23 to the stay 25 and the like, saving energy.

Alternatively, instead of the reflector 26 according to this embodiment, a heater side face of the stay 25, which is disposed opposite the halogen heater 23, may be treated with specular surface finish by polishing, coating, or the like to produce a reflection face. The reflector 26 or the refection face of the stay 25 preferably has a reflectance of 90 percent or more.

A slide sheet 29 impregnated with a lubricant is interposed between the nip formation pad 24 and the fixing belt 21. The slide sheet 29 is a sheet weaved with heat-resistant, fine fluorine fiber or is made of heat-resistant, porous resin. The slide sheet 29 absorbs the lubricant by capillary action.

For example, silicone oil is used as the lubricant. The silicone oil is preferable in view of heat resistance, durability, and lubricity. The silicone oil also preferably provides selection of various viscosities depending on a condition of usage.

Alternatively, fluorine grease or silicone grease may be used as the lubricant.

According to this embodiment, an inner circumferential face 21*b* of the fixing belt 21 is pressed against the nip formation pad 24. Hence, if the inner circumferential face 21*b* of the fixing belt 21 contacts a surface of the nip formation pad 24 with increased friction, the increased friction may degrade rotation of the fixing belt 21, causing faulty fixing of a toner image T on the sheet P and creasing the sheet P, for example. The increased friction may increase a torque of the fixing device 20, shortening a life of the fixing device 20. To address this circumstance, as described above, the fixing device 20 incorporates the slide sheet 29 impregnated with the lubricant. The slide sheet 29 applies the lubricant to the inner circumferential face 21*b* of the fixing belt 21. The lubricant decreases friction between the nip formation pad 24 and the inner circumferential face 21*b* of the fixing belt 21. Thus, the fixing belt 21 rotates smoothly.

Optionally, the fixing device 20 may further include a thermal equalizer that is interposed between the nip formation pad 24 and the fixing belt 21. The thermal equalizer is preferably made of a material having enhanced thermal conductivity such as metal.

A description is provided of a construction of each of a cap 40 and a seal 50 incorporated in the fixing device 20.

Figure 3:
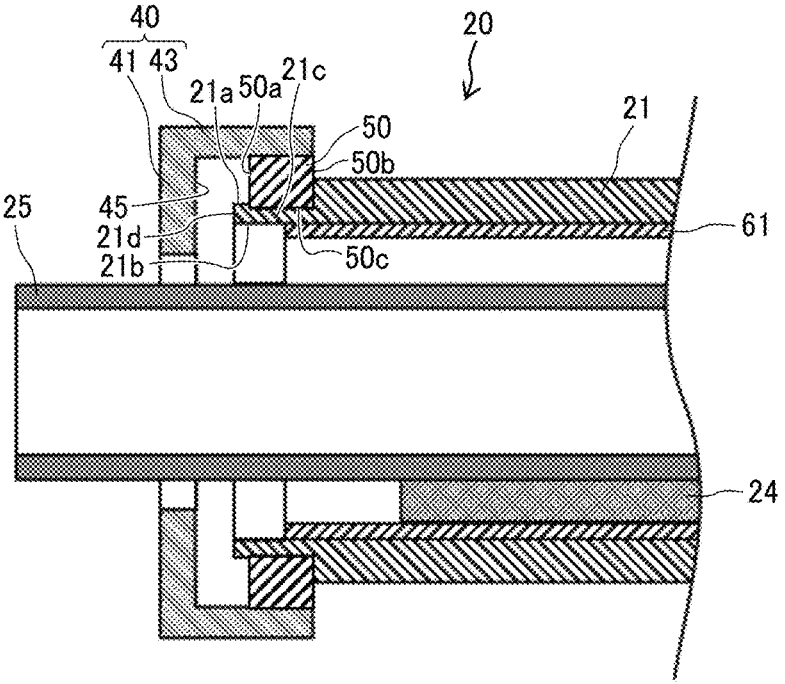
FIG. 3 is a cross-sectional view of the fixing device depicted in FIG. 2, illustrating a seal incorporated therein.

FIG. 3 is a cross-sectional view of the fixing device 20 according to an embodiment of the present disclosure, illustrating the construction of each of the cap 40 and the seal 50.

FIG. 3 illustrates a part of elements of the fixing device 20, that is, the fixing belt 21, the nip formation pad 24 serving as a presser disposed opposite the inner circumferential face 21*b* of the fixing belt 21 via a lubricant 61, the stay 25 that supports the nip formation pad 24, the lubricant 61 that facilitates sliding of the fixing belt 21 over the nip formation pad 24, the cap 40, and the seal 50. FIG. 3 omits other elements of the fixing device 20.

A pair of caps 40 is disposed opposite both lateral ends 21*c* of the fixing belt 21 in the axial direction thereof, respectively. A pair of seals 50 is disposed opposite both lateral ends 21*c* of the fixing belt 21 in the axial direction thereof, respectively. FIG. 3 illustrates one lateral end 21*c* of the fixing belt 21 in the axial direction thereof.

The lubricant 61 may be absorbed by the slide sheet 29 depicted in FIG. 2 or applied to the fixing belt 21.

The cap 40 restricts the lateral end 21*c* of the fixing belt 21 in the axial direction thereof. The cap 40 includes a disk 41 and a tube 43. The disk 41 is disposed opposite an edge face 21*d* of the fixing belt 21. The tube 43 abuts on the disk 41 and extends toward a center of the fixing belt 21 in the axial direction thereof. The tube 43 is disposed opposite the outer circumferential face 21*a* of the fixing belt 21. The cap 40 further includes an opposed face 45 that is mounted on the disk 41 and disposed opposite the edge face 21*d* of the fixing belt 21 in the axial direction thereof.

The seal 50 contacts the outer circumferential face 21*a* of the fixing belt 21 at the lateral end 21*c* of the fixing belt 21 in the axial direction thereof. The seal 50 prevents the lubricant 61 from leaking out to a sheet conveyance region RP, serving as a recording medium conveyance region, depicted in FIG. 4 where the sheet P serving as the recording medium is conveyed. The seal 50 is tubular and includes a top face 50*a* and a bottom face Sob being opposite to the top face 50*a* in the axial direction of the fixing belt 21. The top face 50*a* or the bottom face 50*b* of the seal 50 is disposed opposite the opposed face 45 of the cap 40. At least a part of an inner circumferential face 50*c* of the seal 50 contacts the outer circumferential face 21*a* of the fixing belt 21 to block or seal a gap between the cap 40 and the fixing belt 21. As illustrated in FIG. 3, the seal 50 extends from an inner circumferential face of the tube 43 of the cap 40 to the fixing belt 21. The seal 50 is tubular. The inner circumferential face 50*c* of the seal 50 contacts the outer circumferential face 21*a* of the fixing belt 21.

Figure 4:
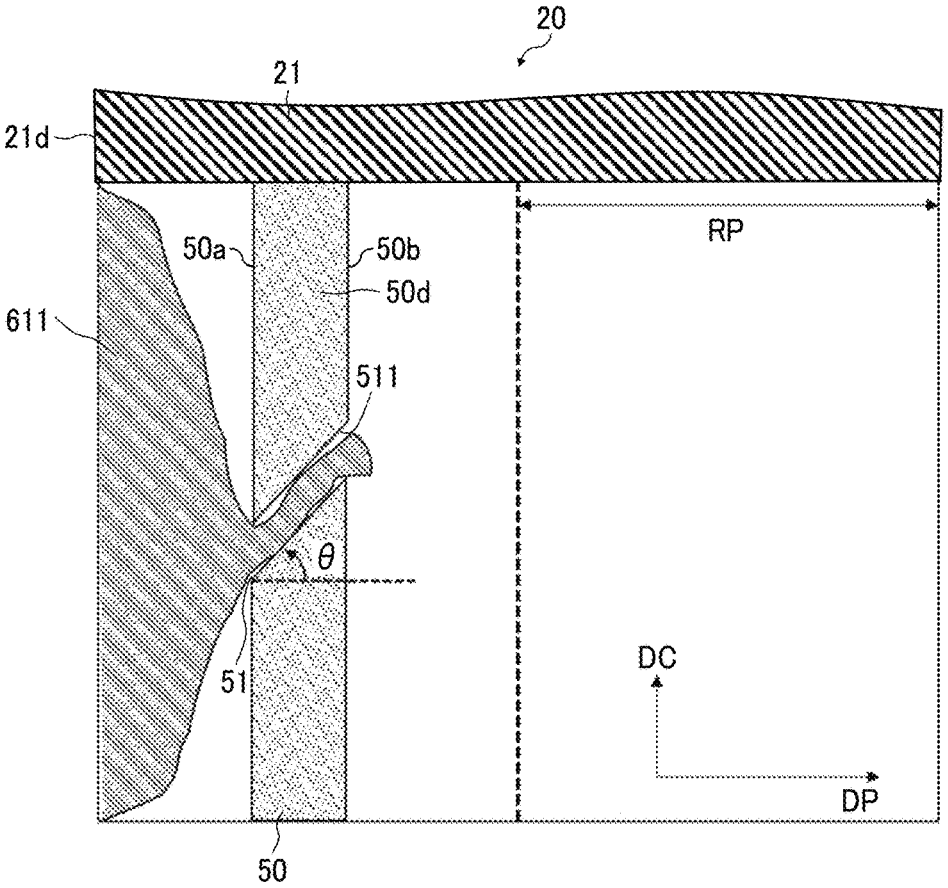
FIG. 4 is a schematic diagram of the fixing device depicted in FIG. 3, illustrating a slit incorporated in the seal as one example.

As illustrated in FIG. 4, the seal 50, that is tubular, includes a slit 51 in a part of a side face 50*d* of the seal 50. For example, the slit 51 is disposed in the side face 50*d* and interposed between the top face 50*a*, and the bottom face 50*b* of the seal 50.

The slit 51 is defined by a slope inclined with respect to the axial direction of the fixing belt 21. A configuration of the slit 51 is described below with reference to FIGS. 4 to 7.

The seal 50 is made of silicone rubber, fluororubber, or the like. Accordingly, as the fixing belt 21 rotates frictionally, the seal 50 and the cap 40 rotate in accordance with rotation of the fixing belt 21 with frictional resistance.

A clearance is provided between an edge face (e.g., the top face 50*a* or the bottom face 50*b*) of the seal 50 and the opposed face 45 of the cap 40.

A description is provided of a configuration of the slit 51 of the seal 50.

In order to facilitate attachment of the seal 50 to the cap 40 or in order to cause the seal 50 having a coefficient of thermal expansion that is different from a coefficient of thermal expansion of the fixing belt 21 to press against the fixing belt 21 appropriately even when the seal 50 expands and contracts thermally, the seal 50 includes the slit 51 disposed at a part of the seal 50 in a circumference thereof.

However, at each lateral end 21*c* of the fixing belt 21 in the axial direction thereof the lubricant 61 leaked out from the inner circumferential face 21*b* onto the outer circumferential face 21*a* of the fixing belt 21 may move through the slit 51 of the seal 50 to the sheet conveyance region RP disposed in a center span on the fixing belt 21 in the axial direction thereof. If the lubricant 61 leaks out to the sheet conveyance region RP, the lubricant 61 may degrade the toner image T on the sheet P. If the lubricant 61 leaks in an increased amount, the lubricant 61 may slip the pressure roller 22 over the fixing belt 21.

To address this circumstance, according to this embodiment, the seal 50 includes the slope that defines the slit 51 and is inclined with respect to the axial direction of the fixing belt 21 at an angle of inclination. The slope suppresses leakage of the lubricant 61 onto the sheet conveyance region RP on the fixing belt 21 as described below in detail.

FIG. 4 is a schematic diagram of the fixing device 20, illustrating the slit 51 according to an embodiment of the present disclosure as one example.

Figure 5:
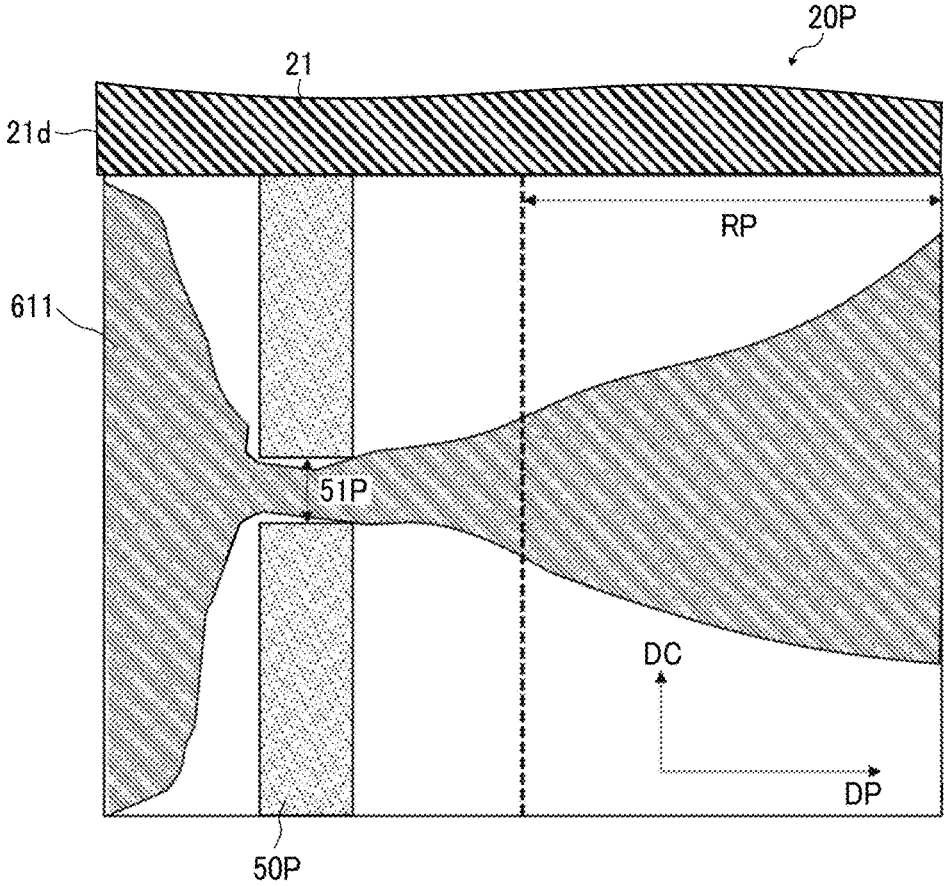
FIG. 5 is a schematic diagram of a fixing device, illustrating a slit as a comparative example.

FIG. 5 is a schematic diagram of a fixing device 20P, illustrating a slit 51P as a comparative example.

FIG. 4 schematically illustrates a part of the fixing device 20 by enlarging a contact portion where the outer circumferential face 21*a* of the fixing belt 21 contacts the inner circumferential face 50*c* of the seal 50. FIG. 4 illustrates the edge face 21*d*, that is, a left edge face, of the fixing belt 21 and does not illustrate another edge face of the fixing belt 21. FIG. 4 illustrates a lubricant 611 as a part of the lubricant 61, which leaks out from the inner circumferential face 21*b* of the fixing belt 21. For example, FIG. 4 illustrates a state in which the lubricant 611 leaks into the clearance between the cap 40 and the seal 50 and a part of the lubricant 611 enters the slit 51 of the seal 50 and leaks onto the outer circumferential face 21*a* of the fixing belt 21.

The seal 50 includes a non-perpendicular portion 511 that is not perpendicular to a circumferential direction DC of the fixing belt 21. The non-perpendicular portion 511 serves as the slope that defines the slit 51. FIG. 4 illustrates an example of the non-perpendicular portion 511 that defines an entirety of the slit 51. The non-perpendicular portion 511 dams the lubricant 611 that leaks toward the center span on the fixing belt 21, which is disposed inboard from the seal 50 in the axial direction of the fixing belt 21.

The non-perpendicular portion 511 preferably defines the slit 51 that is inclined with respect to the axial direction of the fixing belt 21 at an angle of inclination θ that is not smaller than 30 degrees. The axial direction of the fixing belt 21 is parallel to a perpendicular direction DP that is perpendicular to the circumferential direction DC of the fixing belt 21. As the angle of inclination θ is closer to 90 degrees, the slit 51 suppresses leakage of the lubricant 611 onto the sheet conveyance region RP on the fixing belt 21 more effectively.

Conversely, the fixing device 20P as the comparative example depicted in FIG. 5 includes a seal 50P having the slit 51P that is perpendicular to the circumferential direction DC of the fixing belt 21. FIG. 5 schematically illustrates the lubricant 611 that leaks onto the sheet conveyance region RP on the fixing belt 21. As illustrated in FIG. 5, the lubricant 611 leaked out from the edge face 21*d* of the fixing belt 21 moves through the slit 51P to the sheet conveyance region RP on the fixing belt 21.

As described above, the fixing device 20 according to the embodiment of the present disclosure includes the seal 50 that is mounted on the cap 40 and tubular. The inner circumferential face 50*c* of the seal 50 contacts the outer circumferential face 21*a* of the fixing belt 21. The seal 50 includes the slit 51 disposed in a part of the tubular, side face 50*d* of the seal 50. The slit 51 causes the seal 50 to press against the fixing belt 21 appropriately even when the seal 50 expands thermally. The slit 51 is defined by the non-perpendicular portion 511.

Since the non-perpendicular portion 511 defines the slit 51, the slit 51 dams the lubricant 611 that leaks out onto the center span on the fixing belt 21 in the axial direction thereof.

As described above, the fixing device 20 according to this embodiment prevents the lubricant 611 from staining the fixing belt 21 in the sheet conveyance region RP where the toner image 1 on the sheet P contacts the fixing belt 21 with a simple construction.

A description is provided of modification examples of the slit 51 depicted in FIG. 4.

Figure 6:
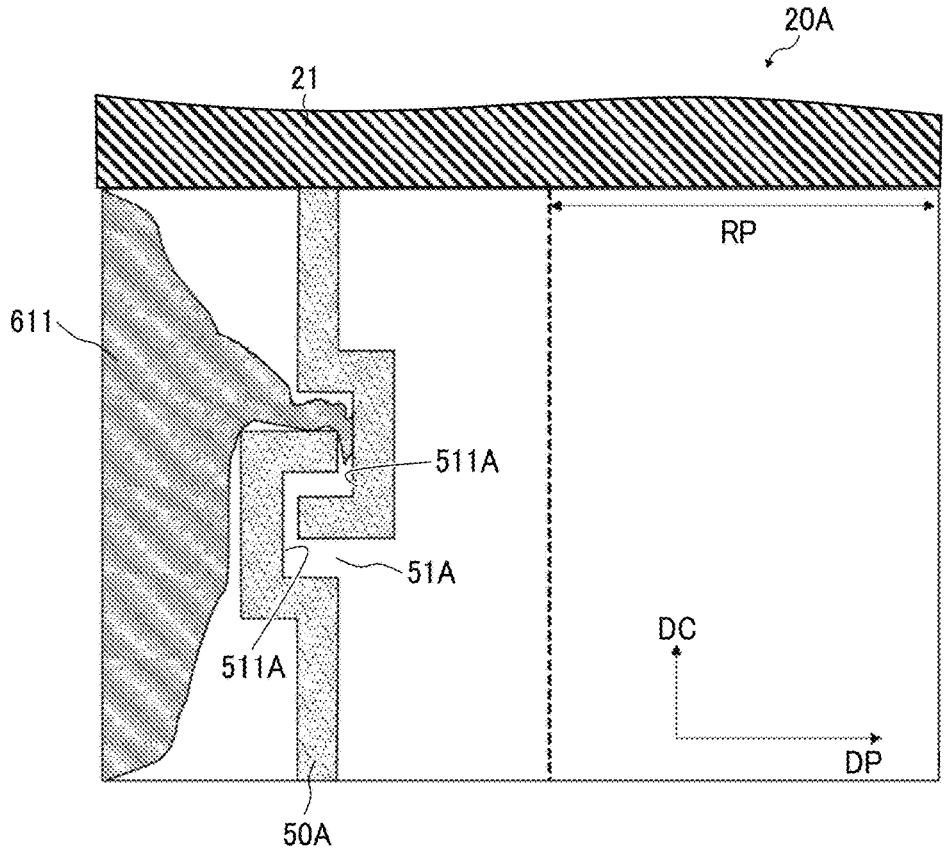
FIG. 6 is a schematic diagram of a fixing device installable in the image forming apparatus depicted in FIG. 1, illustrating a slit as a first modification example of the slit depicted in FIG. 4.

FIG. 6 is a schematic diagram of a fixing device 20A incorporating a seal 50A, illustrating a slit 51A as a first modification example of the slit 51 depicted in FIG. 4.

Figure 7:
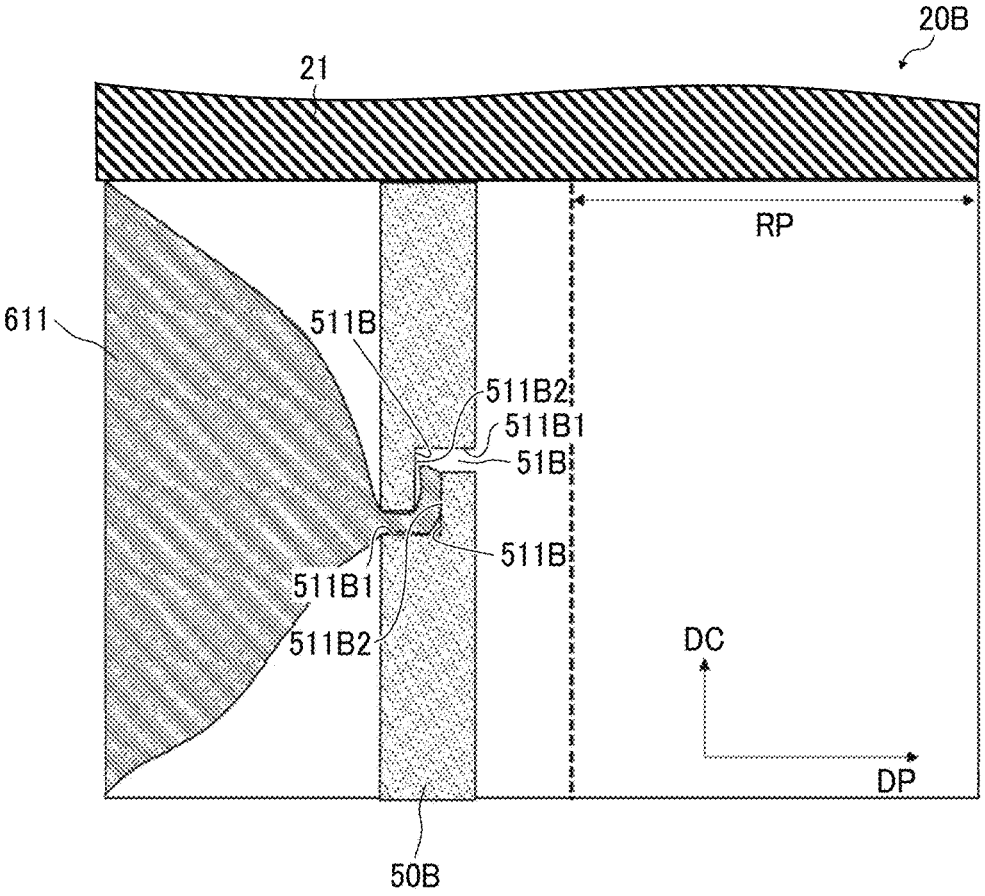
FIG. 7 is a schematic diagram of a fixing device installable in the image forming apparatus depicted in FIG. 1, illustrating a slit as a second modification example of the slit depicted in FIG. 4.

FIG. 7 is a schematic diagram of a fixing device 20B incorporating a seal 50B, illustrating a slit 51B as a second modification example of the slit 51 depicted in FIG. 4.

Other construction of each of the fixing devices 20A and 20B depicted in FIGS. 6 and 7, respectively, is equivalent to that of the fixing device 20 depicted in FIG. 4.

The slits 51A and SIB depicted in FIGS. 6 and 7, respectively, have modified patterns modified from a pattern of the slit 51 depicted in FIG. 4. As illustrated in FIG. 6, the slit 51A is defined by non-perpendicular portions 511A each of which is U-shaped. The non-perpendicular portions 511A are coupled with each other to define the modified pattern. As illustrated in FIG. 7, the slit 51B is defined by non-perpendicular portions 511B each of which is L-shaped. Each of the non-perpendicular portions 511B includes a parallel portion 511B1 that is parallel to the axial direction (e.g., the perpendicular direction DP) of the fixing belt 21 and a perpendicular portion 511B2 that is perpendicular to the axial direction of the fixing belt 21. The non-perpendicular portions 511B are coupled with each other to define the modified pattern. The slits 51A and 51B suppress leakage of the lubricant 611 onto the sheet conveyance region RP on the fixing belt 21 more effectively.

The seals 50, 50A, and 50B of the fixing devices 20, 20A, and 20B according to the embodiments described above, respectively, are preferably made of an elastic, porous material. The seals 50, 50A, and 50B made of the porous material absorb the lubricant 611 while the patterns of the slits 51, 51A, and 51B dam the lubricant 611, thus suppressing leakage of the lubricant 611 onto the sheet conveyance region RP on the fixing belt 21 effectively.

The seals 50, 50A, and 50B are disposed opposite both lateral ends 21*c* of the fixing belt 21, which are outboard from a maximum conveyance span in the axial direction of the fixing belt 21. A sheet P having a maximum width in the axial direction of the fixing belt 21, which is available in the fixing devices 20, 20A, and 20B, is conveyed over the maximum conveyance span. For example, the seals 50, 50A, and 50B are disposed outboard from the sheet conveyance region RP in the axial direction of the fixing belt 21. Thus, the seals 50, 50A, and 50B prevent the lubricant 611 from leaking out to the sheet conveyance region RP on the fixing belt 21.

A description is provided of a construction of each of fixing devices 20C and 20D according to other embodiments of the present disclosure.

A description is provided of modification examples of the seal 50 depicted in FIG. 3, FIG. 3 illustrates the tubular seal 50 including the top face 50*a* and the bottom face 50*b* that have a similar size. Alternatively, the seal 50 may be a tube including a top face and a bottom face that have different sizes or shapes, respectively. For example, the seal 50 may be a tube that has a step between the top face and the bottom face.

Figure 8A:
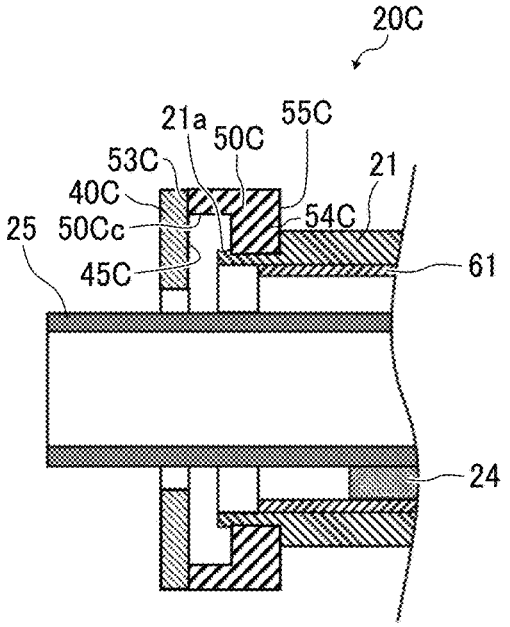
FIG. 8A is a cross-sectional view of a fixing device installable in the image forming apparatus depicted in FIG. 1, illustrating a seal as a first modification example of the seal depicted in FIG. 3.
Figure 8B:
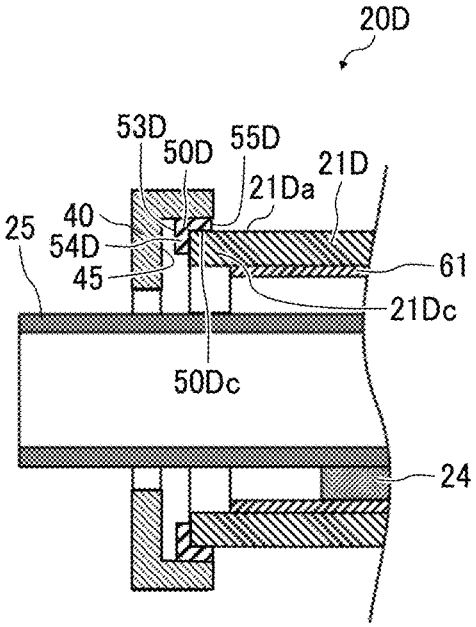
FIG. 8B is a cross-sectional view of a fixing device installable in the image forming apparatus depicted in FIG. 1, illustrating a seal as a second modification example of the seal depicted in FIG. 3.

FIGS. 8A and 8B illustrate the fixing devices 20C and 20D that include seals 50C and 50D, respectively, as the modification examples of the seal 50 depicted in FIG. 3. As illustrated in FIG. 8A, the seal 50C includes a top face 53C as an edge face that is disposed opposite an opposed face 45C of a cap 40C and a bottom face 55C as an edge face that is opposite to the top face 53C and is disposed in proximity to the sheet conveyance region RP on the fixing belt 21. As illustrated in FIG. 8B, the seal 50D includes a top face 53D as an edge face that is disposed opposite the opposed face 45 of the cap 40 and a bottom face 55D as an edge face that is opposite to the top face 53D and is disposed in proximity to the sheet conveyance region RP on a fixing belt 21D. Each of the seals 50C and 50D is tubular.

As illustrated in FIG. 8A, an inner circumference of the top face 53C is greater than an inner circumference of the bottom face 55C. As illustrated in FIG. 8B, an inner circumference of the bottom face 55D is greater than an inner circumference of the top face 53D.

As illustrated in FIG. 8A, the seal 50C includes a step 54C on an inner circumferential face 50Cc of the seal 50C. A length of the inner circumference of the top face 53C (e.g., a diameter of the top face 53C) is greater than a length of the inner circumference of the bottom face 55C (e.g., a diameter of the bottom face 55C).

As illustrated in FIG. 8B, the seal 50D includes a step 54D on an inner circumferential face 50Dc of the seal 50D. A length of the inner circumference of the top face 53D (e.g., a diameter of the top face 5:1D) is smaller than a length of the inner circumference of the bottom face 55D (e.g., a diameter of the bottom face 55D).

As illustrated in FIG. 3, an entirety of the inner circumferential face 50*c* of the seal 50 contacts the outer circumferential face 21*a* of the fixing belt 21. Conversely, as illustrated in FIG. 8A, a part of the inner circumferential face 50Cc of the seal 50C contacts the outer circumferential face 21*a* of the fixing belt 21. As illustrated in FIG. SB, a part of the inner circumferential face 50Dc of the seal 50D contacts an outer circumferential face 21Da, of the fixing belt 21D.

As illustrated in FIG. 8A, the seal 50C includes the step 54C mounted on the inner circumferential face 50Cc of the seal 50C. The step 54C is tubular. A length of an inner circumference of the step 54C is smaller than the length of the inner circumference of the top face 53C. As illustrated in FIG. 8B, the seal 50D includes the step 54D mounted on the inner circumferential face 50Dc of the seal 50D. The step 54D is tubular. A length of an inner circumference of the step 54D is smaller than the length of the inner circumference of the bottom face 55D.

Alternatively, the seals 50C and 50D may include two steps mounted on the inner circumferential faces 50Cc and 50Dc of the seals 50C and 50D, respectively. A length of an inner circumference of a center portion of each of the seals 50C and 50D is smaller than a length of an inner circumference of each lateral end portion (e.g., the top faces 53C and 53D and the bottom faces 55C and 55D) of each of the seals 50C and 50D in the axial direction of the fixing belt 21.

Accordingly, the seal 50C fits a shape of the cap 40C readily. The seal 50D fits a shape of each lateral end 21Dc of the fixing belt 21D in an axial direction thereof readily.

According to the embodiments described above, each of the seals 50, 50A, 50B, 50C, and 50D is a tube. However, a seal employing the technology of the present disclosure is not limited to the seals 50, 50A, 50B, 50C, and 50D. For example, the technology of the present disclosure is applied to a seal that is hollow and includes an inner circumferential face that is tubular and in contact with the outer circumferential face 21*a* of the fixing belt 21.

The technology of the present disclosure is not limited to the embodiments described above. The components and the elements of the embodiments described above may be modified, added, and converted into configurations suggested readily by those skilled in art within the scope of the present disclosure. Two or more of the embodiments described above may be combined properly.

A description is provided of advantages of a fixing device (e.g., the fixing devices 20, 20A, 20B, 20C, and 20D).

As illustrated in FIGS. 2, 3, and 4, the fixing device includes a fixing belt (e.g., the fixing belts 21 and 21D), a presser (e.g., the nip formation pad 24), a pressure roller (e.g., the pressure roller 22), a cap (e.g., the caps 40 and 40C), and a seal (e.g., the seals 50, 50A, 50B, 50C, and 50D).

The fixing belt is an endless belt and is rotatable in a rotation direction e.g., the rotation direction D21).

The presser is disposed opposite an inner circumferential face (e.g., the inner circumferential face 21*b*) of the fixing belt via a lubricant (e.g., the lubricant 61).

The pressure roller sandwiches the fixing belt together with the presser to form a pressing region (e.g., the fixing nip N) through which a recording medium (e.g., the sheet P) is conveyed.

The cap is disposed opposite a lateral end (e.g., the lateral ends 21*c* and 21Dc) of the fixing belt in an axial direction (e.g., the perpendicular direction DP) thereof. The cap includes an opposed face (e.g., the opposed faces 45 and 45C) disposed opposite an edge face (e.g., the edge face 21*d*) of the fixing belt in the axial direction thereof.

The seal is tubular and includes a top face (e.g., the top faces 50*a*, 53C, and 53D) and a bottom face (e.g., the bottom faces 50*b*, 55C, and 55D). One of the top face and the bottom face of the seal is disposed opposite the opposed face of the cap. At least a part of an inner circumferential face (e.g., the inner circumferential faces 50*c*, 50Cc, and 50Dc) of the seal contacts an outer circumferential face (e.g., the outer circumferential faces 21*a* and 21Da) of the fixing belt to seal a gap between the cap and the fixing belt.

The seal includes a slit (e.g., the slits 51, 51A, and 51B) that is disposed in a side face (e.g., the side face 50*d*) of the seal and interposed between the top face and the bottom face of the seal.

The slit is defined by a slope or a non-perpendicular portion (e.g., the non-perpendicular portions 511, 511A, and 511B) that is inclined with respect to the axial direction of the fixing belt.

Accordingly, the seal of the fixing device prevents the lubricant applied to the inner circumferential face of the fixing belt from leaking out to a recording medium conveyance region (e.g., the sheet conveyance region RP) on the fixing belt, which contacts an image (e.g., the toner image T) on the recording medium.

According to the embodiments described above, the fixing belt 21 serves as a fixing rotator or a fixing belt. Alternatively, a fixing film, a fixing sleeve, or the like may be used as a fixing rotator or a fixing belt. Further, the pressure roller 22 serves as a pressure rotator. Alternatively, a pressure belt or the like may be used as a pressure rotator.

According to the embodiments described above, the image forming apparatus 1 is a printer. Alternatively, the image forming apparatus 1 may be a copier, a facsimile machine, a multifunction peripheral (MFP) having at least two of copying, printing, scanning, facsimile, and plotter functions, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing belt being endless, the fixing belt configured to rotate;

a nip formation pad disposed opposite an inner circumferential face of the fixing belt via a lubricant;

a pressure roller configured to sandwich the fixing belt together with the nip formation pad to form a pressing region through which a recording medium is conveyed;

a cap disposed opposite a lateral end of the fixing belt in an axial direction of the fixing belt; and a seal being tubular, the seal configured to contact an outer circumferential face of the fixing belt in at least a part of an inner circumferential face of the seal, the seal configured to seal a gap between the cap and the fixing belt, the seal including a non-perpendicular portion being not perpendicular to a circumferential direction of the fixing belt, the non-perpendicular portion defining a slit.

2. The fixing device according to claim 1, wherein the cap has an opposed face disposed opposite an edge face of the fixing belt in the axial direction of the fixing belt.

3. The fixing device according to claim 2, wherein the seal has a top face and a bottom face being opposite to the top face in the axial direction of the fixing belt, and wherein one of the top face and the bottom face of the seal is disposed opposite the opposed face of the cap.

4. The fixing device according to claim 3, wherein the seal further has a side face interposed between the top face and the bottom face of the seal, and wherein the slit is disposed in the side face of the seal.

5. The fixing device according to claim 3, wherein an inner circumference of the top face of the seal is smaller than an inner circumference of the bottom face of the seal.

6. The fixing device according to claim 5, wherein the seal further includes a step mounted on an inner circumferential face of the seal, the step defining the top face of the seal.

7. The fixing device according to claim 1, wherein the non-perpendicular portion includes a slope being inclined with respect to the axial direction of the fixing belt at an angle not smaller than 30 degrees.

8. The fixing device according to claim 1, wherein the seal is disposed outboard from a recording medium conveyance region on the fixing belt in the axial direction of the fixing belt, the recording medium conveyance region where the recording medium is conveyed.

9. The fixing device according to claim 1, wherein the seal is made of an elastic, porous material that absorbs the lubricant.

10. The fixing device according to claim 1, wherein the non-perpendicular portion is U-shaped.

11. The fixing device according to claim 10, wherein the seal further includes another non-perpendicular portion being U-shaped and coupled with the non-perpendicular portion.

12. The fixing device according to claim 1, wherein the non-perpendicular portion includes:

a parallel portion being parallel to the axial direction of the fixing belt; and a perpendicular portion being perpendicular to the axial direction of the fixing belt.

13. The fixing device according to claim 12, wherein the seal further includes another non-perpendicular portion being not perpendicular to the circumferential direction of the fixing belt and including:

a parallel portion being parallel to the axial direction of the fixing belt; and a perpendicular portion being perpendicular to the axial direction of the fixing belt, and wherein said another non-perpendicular portion is coupled with the non-perpendicular portion.

14. An image forming apparatus comprising:

an image bearer configured to bear an image; and a fixing device configured to fix the image on a recording medium, the fixing device including:

a fixing belt being endless, the fixing belt configured to rotate;

a nip formation pad disposed opposite an inner circumferential face of the fixing belt via a lubricant;

a pressure roller configured to sandwich the fixing belt together with the nip formation pad to form a pressing region through which the recording medium is conveyed;

a cap disposed opposite a lateral end of the fixing belt in an axial direction of the fixing belt; and a seal being tubular, the seal configured to contact an outer circumferential face of the fixing belt in at least a part of an inner circumferential face of the seal, the seal configured to seal a gap between the cap and the fixing belt, the seal including a non-perpendicular portion being not perpendicular to a circumferential direction of the fixing belt, the non-perpendicular portion defining a slit.

* * * * *